US006647550B1

(12) United States Patent
Matsuzaki et al.

(10) Patent No.: US 6,647,550 B1
(45) Date of Patent: Nov. 18, 2003

(54) RACING SWIMSUIT

(75) Inventors: Takeshi Matsuzaki, Osaka (JP); Kenjiro Mori, Osaka (JP); Katsuhiro Kinoshita, Osaka (JP); Ujiteru Niwa, Shiga (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 09/492,598

(22) Filed: Jan. 27, 2000

(30) Foreign Application Priority Data

Apr. 27, 1999 (JP) ..... 11-120704

(51) Int. Cl.[7] ..... B32B 9/00; B64L 1/38
(52) U.S. Cl. ..... 2/67; 244/130; 442/59
(58) Field of Search ..... 244/130; 442/59; 2/67

(56) References Cited

U.S. PATENT DOCUMENTS

| | | | |
|---|---|---|---|
| 4,972,522 | A | 11/1990 | Rautenberg et al. |
| 4,986,496 | A | 1/1991 | Marentic et al. |
| 5,069,403 | A | 12/1991 | Marentic et al. |
| 5,133,516 | A | 7/1992 | Marentic et al. |

FOREIGN PATENT DOCUMENTS

| | | | | |
|---|---|---|---|---|
| EP | 0411351 | | 2/1991 | |
| EP | 0411351 | A1 * | 2/1991 | ..... A41D/13/00 |
| EP | 0616940 | | 9/1994 | |
| EP | 0616940 | A1 * | 9/1994 | ..... B63B/1/38 |
| JP | 48-39376 | | 11/1973 | |
| JP | 55-26243 | | 2/1980 | |
| JP | 60-67312 | | 5/1985 | |
| JP | 4-366631 | | 12/1992 | |
| JP | 6-12419 | | 2/1994 | |
| JP | 6-79786 | | 11/1994 | |
| JP | 09049107 | * | 2/1995 | ..... A41D/7/00 |
| JP | 09049107 | * | 7/1995 | ..... A41D/7/00 |

OTHER PUBLICATIONS

SWIMWEAR Catalogue, Teflon SW, 11/94.

* cited by examiner

*Primary Examiner*—Terrel Morris
*Assistant Examiner*—Alexis Wachtel
(74) *Attorney, Agent, or Firm*—Piper Rudnick LLP

(57) ABSTRACT

The present invention relates to a racing swimsuit and provides a racing swimsuit capable of reducing surface friction resistance and frictional resistance of turbulence in water.

The present invention can reduce the surface frictional resistance in water by the provision of a water repellent region on the surface of a swimsuit as well as makes it possible to reduce the frictional resistance of turbulence occurred on the surface of the swimsuit of a racer by the formation of a plurality of fine grooves parallel to a body lengthwise direction.

11 Claims, 9 Drawing Sheets

RACING SWIMSUIT

BACKGROUND OF THE INVENTION

The present invention relates to a racing swimsuit. More particularly, the present invention relates to a racing swimsuit capable of reducing surface frictional resistance in water by providing a water repellent region on the surface of the swimsuit as well as being capable of reducing turbulence frictional resistance occurring on the surface of the swimsuit of a racer by forming a plurality of fine grooves parallel to a body lengthwise direction.

The function which is most required to racing swimsuits is how the surface frictional resistance of the swimsuits, which is caused in a race, is reduced in water, and there have been proposed various technologies for reducing the surface frictional resistance of the swimsuits.

For example, Japanese Examined Utility Model Publication No. 63-39206 discloses a swimsuit characterized in that concave portions or convex potions each having a thin width are disposed in a body lengthwise direction when the swimsuit is worn for the purpose of promptly escaping the resistance of water applied to the swimsuit in a race. Japanese Examined Utility Model Publication No. 5-38006 discloses a swimsuit having a non-permeable sheet bonded to a portion adjacent to the opening of the swimsuit for the purpose of obtaining the flow straightening effect of the surface of the swimsuit in a race.

Further, Japanese Unexamined Patent Publication No. 8-311751 and Japanese Unexamined Patent Publication No. 9-49107 disclose a technology for providing water repellent sections and non-water repellent sections on the surface of fabric for the purpose of reducing the frictional resistance on the surface of the fabric and securing a water releasing property.

While racing swimsuits have been variously improved as described above, there still remain problems to be solved as follows.

That is, it is possible to reduce the surface frictional resistance between a fluid and the surface of clothes when the clothes have a water repellent treatment applied to the surface of the fabric thereof. However, the occurrence of the turbulence of the fluid flowing on the surface of the fabric cannot be suppressed in such clothes, thus there is a limit in a resistance reducing effect.

Thus, there has been desired racing swimsuits which solve the above problems and reduce the surface frictional resistance as well as suppress the occurrence of turbulence on the surface of clothes, thereby reducing the resistance of a racer.

DISCLOSURE OF THE INVENTION

A racing swimsuit according to the present invention comprising an elastic fabric characterized in that a water repellent treatment is applied to the entire surface of the swimsuit to reduce surface friction resistance and a plurality of fine grooves parallel to a body lengthwise direction are formed to suppress the occurrence of turbulence on the surface of the swimsuit.

Hereinafter, "the surface of the swimsuit" means the surface which contacts the water, that is, the outside surface of the swimsuit.

A racing swimsuit according to the present invention can be arranged such that a water repellent treatment is applied to the entire surface of the swimsuit and the swimsuit has groove sections, in which a plurality of fine grooves parallel to a body lengthwise direction are formed, on at least a portion thereof; a plurality of fine grooves parallel to a body lengthwise direction are formed on the entire surface of the swimsuit and the swimsuit has a water repellent region, to which a water repellent treatment is applied, on at least a portion thereof; and the swimsuit has a water repellent region, to which a water repellent treatment is applied, on at least a portion of the surface thereof as well as has groove sections, in which a plurality of fine grooves parallel to a body lengthwise direction are formed, formed on at least a portion thereof.

In the racing swimsuit according to the present invention, when the swimsuit is provided with the groove sections in which a plurality of fine grooves parallel to the body lengthwise direction are formed on at least a portion thereof, it is possible to form the groove sections in the shape of stripes parallel to the body lengthwise direction.

Further, when the racing swimsuit has the water repellent region in which the water repellent treatment is applied to at least a portion thereof, it is also possible to form the water repellent region in the shape of stripes parallel to the body lengthwise direction.

In the racing swimsuit according to the present invention, the water repellent region is composed of intermittently-water-repellent segments in which water repellent sections, to which the water repellent treatment is applied, and non-water-repellent sections, to which no water repellent treatment is applied, are intermittently formed and which are formed in the shape of stripes parallel to the body lengthwise direction, or the water repellent region is composed of intermittently-water-repellent segments in which water repellent sections, to which the water repellent treatment is applied, and non-water-repellent sections, to which no water repellent treatment is applied, are intermittently formed and continuously-water-repellent segments to which the water repellent treatment is continuously applied, and the intermittently-water-repellent segments and the continuously-water-repellent segments are formed in the shape of stripes parallel to the body lengthwise direction.

In the racing swimsuit according to the present invention, when the racing swimsuit has the intermittently-water-repellent segments in the water repellent region, it is possible that the water repellent sections of the intermittently-water-repellent segments are formed by being at least partially coupled with the continuously-water-repellent segments or without being coupled therewith.

In the racing swimsuit according to the present invention, when the water repellent region has the intermittently-water-repellent segments, it is preferable that both the upper and lower edges of the water repellent sections of the intermittently-water-repellent segments are formed such that they have angles of −60° to 60° to the body lengthwise direction to reduce surface frictional resistance in water and to secure an effective water releasing property.

In the racing swimsuit according to the present invention, it is preferable that the ratio of the area of water repellent sections occupied in the area of the water repellent region is 70 to 90%.

When the ratio of the area of the water repellent sections occupied in the area of the water repellent sections is the above ratio, an optimum water releasing property can be secured while reducing the surface frictional resistance.

In the racing swimsuit according to the present invention, it is also possible that the groove sections are formed by the structural change of the woven structure or the knitted structure of the fabric forming the racing swimsuit. Further, it is also possible to form the groove sections by an embossing treatment applied to the surface of the fabric.

In the racing swimsuit according to the present invention, it is preferable that the grooves for forming the groove sections have a depth of 20 to 500 $\mu$m, a width of 200 to 1500 $\mu$m and a pitch of 300 to 3000 $\mu$m.

In the racing swimsuit according to the present invention, it is possible to apply a smoothing treatment to the region of the surface of the fabric forming the racing swimsuit other than the groove section thereof.

(Reference Numerals)

Figure 1A:
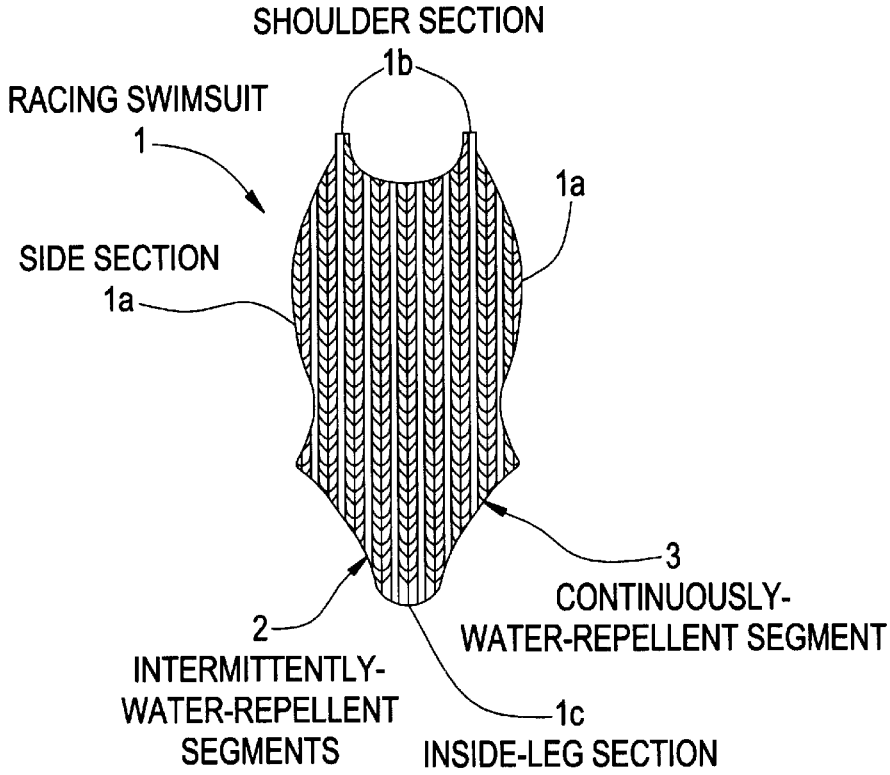
FIG. 1 is a front elevational view (A) and a rear elevational view (B) of a racing swimsuit according to the present invention.

1. racing swimsuit
1*a*. side section
1*b*. shoulder section
1*c*. inside-leg section
2. continuously-water-repellent segment
2*a*. side edge
2*b*. right edge
3. intermittently-water-repellent segment
3*a*. water repellent section
3*b*. non-water repellent section
3*c*. center line
3*d*. upper edge
3*e*. lower edge
4. groove
5. column
6. glass plate
7. fabric to be tested
8. circulating water passage
9. metal column
10. strain gauge

DESIRABLE EMBODIMENTS

An embodiment of a racing swimsuit according to the present invention will be described.

The racing swimsuit according to the present invention is a racing swimsuit comprising an elastic fabric and it can be fitted to a human body by the use of the elastic fabric.

Used as the material of the fabric used for the racing swimsuit according to the present invention are a knitted fabric and a woven fabric comprising knitted union cloth or woven union cloth of multi-filament threads of synthetic fibers of polyamide, polyester, polypropylene and the like or knitted union cloth or woven union cloth of the multi-filament threads of the above synthetic fibers and elastic polyurethane threads.

In particular, since movability is essential to the racing swimsuit, the knitted fabric comprising the woven union cloth of the multi-filament threads of the synthetic fibers and the polyurethane elastic threads is more preferable as the form of the material.

Further, any of a single circular knitted fabric and a double circular knitted fabric as a circular knitted fabric and a tricot fabric and a raschel fabric as a warp knitted fabric can be used as the form of the knitted fabric. However, the tricot fabric is more preferable from the view point of a stretching property, the thinness of the fabric and the like.

Water repellent sections, to which a water repellent treatment is applied to reduce surface frictional resistance, and a plurality of fine grooves parallel to the body lengthwise direction for suppressing the occurrence of turbulence on the surface of the racing swimsuit according to the present invention are formed in combination on the surface thereof.

That is, possible as the combinations of the water repellent sections and the grooves are such that the water repellent treatment is applied to the entire surface of the racing swimsuit and a plurality of fine grooves parallel to the body lengthwise direction are formed on the entire surface of the racing swimsuit; the water repellent treatment is applied to the entire surface of the racing swimsuit and groove sections, in each of which a plurality of fine grooves parallel to the body lengthwise direction are formed, are provided with at least a portion of the surface of the racing swimsuit; a plurality of fine grooves parallel to the body lengthwise direction are formed on the entire surface of the racing swimsuit and a water repellent region, to which the water repellent treatment is applied, are provided with at least a portion of the surface of the racing swimsuit; or a water repellent region, to which the water repellent treatment is applied, are provided with at least a portion of the surface of the racing swimsuit and groove sections, in each of which a plurality of fine grooves parallel to the body lengthwise direction are formed, are provided with at least a portion of the surface.

The combinations are determined by examining the distribution of the velocities of water flow flowing on the surface of the racing swimsuit, the directions of the water flow, the distribution of pressure applied by the water flow and the like and in accordance with race events to have an effect of reducing the surface frictional resistance resulting from the water repellent treatment and an effect of suppressing the occurrence of turbulence obtained by the fine groove structure in multiplication.

That is, since speed is required in short distance race events, it is preferable to apply the water repellent treatment to the entire surface to reduce the surface frictional resistance as much as possible. In contrast, in long distance race events, it is preferable to apply the water repellent treatment to a portion of the entire surface of the swimsuit to secure a water releasing property for releasing water penetrating into the swimsuit in a race.

Further, it is preferable to form the fine grooves on the entire surface of the swimsuit in the breaststroke and the like in which less rolling is caused in an advancing direction.

However, it is also possible to partially form the grooves on the surface of the swimsuit at the effective portions thereof in an effective fashion in the crawl and the like in which rolling is common.

When the grooves are formed on at least a portion of the surface of the swimsuit, it is also possible to uniformly form the grooves on the entire surface of the region where they are formed. However, it is preferable that groove sections are arranged such that a plurality of fine grooves parallel to the body lengthwise direction are formed therein and the groove sections are formed in the shape of stripes parallel to the body lengthwise direction in the region where the grooves are formed.

For example, it is also possible to form the groove sections in the shape of stripes parallel to the body lengthwise direction on the entire surface of the racing swimsuit or to form them only on a bulge portion such as the breast and the buttocks.

Further, in the swimsuit having a water repellent region in which the water repellent treatment is applied to at least a portion thereof, it is also possible to uniformly apply the water repellent treatment to the entire surface of the water repellent region. However, it is preferable to apply the water repellent treatment in the shape of stripes parallel to the body lengthwise direction in the water repellent region.

At the time, the width of the stripes can be suitably adjusted.

When the water repellent treatment is applied to the water repellent region in the shape of stripes, it is also possible to form intermittently-water-repellent segments, in which water repellent sections to which the water repellent treatment is applied and non-water repellent sections to which no water repellent treatment is applied are intermittently formed, in the shape of stripes parallel to the body lengthwise direction.

At the time, it is preferable that the upper and lower edges of each water repellent section have angles of −60° to 60° with respect to the body lengthwise direction.

That is, fewer portions are at a right angle to the water flow in the case both the upper and lower edges of each water repellent section are formed at the predetermined angles, which is effective to reduce the surface frictional resistance in water and to secure an effective water releasing property.

Figure 5:
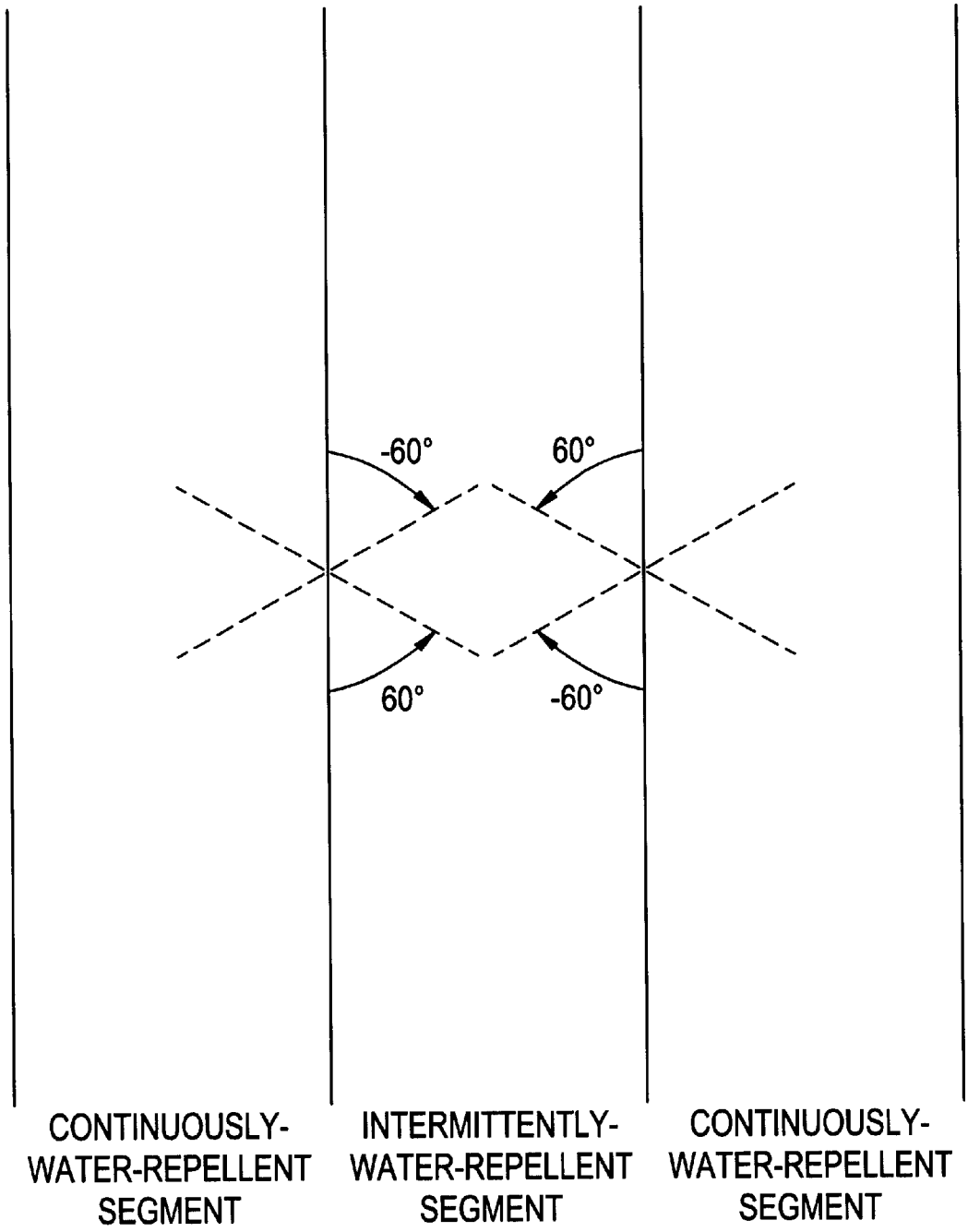
FIG. 5 is a view showing how angles are measured in the present invention.

Note that, in the present invention, a method of measuring the above angles is such that 0° to 60° are measured counterclockwise and 0° to −60° are measured clockwise with respect to the body lengthwise direction as shown in FIG. 5.

Further, when the water repellent treatment is applied to the water repellent region in the shape of stripes, it is possible to form the intermittently-water-repellent segments and the continuously-water-repellent segments, to which the water repellent treatment is continuously applied, to in the shape of stripes parallel to the body lengthwise direction.

At the time, the width of the stripes can be suitably adjusted.

The directions of the respective stripes must be prescribed based on the directions in which water flows along a human body. From that point of view, the stripes are disposed substantially parallel to the body lengthwise direction in the front body portion, back body portion, waist portion, armpit portion and the like.

In contrast, as to the portions corresponding to the side portion and the protruding portions of a human body, it is more preferable to select the directions, in which the stripes are disposed, such that they have a predetermined angle with respect to the body lengthwise direction in consideration of the directions of water flow in a race.

In the racing swimsuit according to the present invention which has the intermittently-water-repellent segments in the water repellent region, it is possible that the water repellent sections of each intermittently-water-repellent segment are formed so as to be at least partially coupled with the continuously-water-repellent segments.

At the time, the ratio of the area of the water repellent sections occupied in the area of a water repellent region is increased, which contributes to the reduction of the surface frictional resistance.

In contrast, it is also possible to form the water repellent sections of the intermittently-water-repellent segments so that they are not coupled with the continuously-water-repellent segment.

At the time, the deterioration of the elasticity of the water repellent region can be prevented.

In the racing swimsuit according to the present invention, it is preferable that the ratio of the area of the water repellent sections occupied in the area of the water repellent region is 70 to 90% to secure an optimum water releasing property while reducing the surface frictional resistance.

Note that the ratio of the area of the water repellent region occupied in the entire area of the racing swimsuit is not particularly limited, and it is determined based on the use, function and the like of the racing swimsuit such as from several tens of percentages only on the breast, only on the buttocks and the like to the entire surface of the swimsuit.

A water repellent agent used in the racing swimsuit according to the present invention can be suitably selected from various types of conventionally used water repellent agents such as a silicone water repellent agent, a fluorine water repellent agent and the like.

Further, treatment agents used for the water repellent sections of the racing swimsuit according to the present invention are not stuck to the name "water repellent agent" and any treatment agent may be used so long as it substantially reduces the surface frictional resistance of a swimsuit in water by an water repellent effect. For example, treatment agents named as a print agent, sealing agent and the like may be used.

A printing treatment, which has been ordinarily used industrially, is preferable as a method of adhering the water repellent agent on the surface of a fabric, and an apparatus to be used for the adhesion thereof may be suitably selected from a roller printing machine, an automatic screen printing machine, a hand screen printing machine and the like.

It is preferable to carry out post treatments such as a heat treatment and the like for the purpose of accelerating a cross-linking reaction for adhering the water repellent agent on the fabric based on an ordinary water repellent treatment. The heat treatment for the acceleration of the cross-linking reaction can be carried out by an ordinary pin tenter or the like.

In the racing swimsuit according to the present invention, it is possible to from the groove sections by the structural change of the woven structure or the knitted structure of the fabric forming the racing swimsuit.

Specifically, when a raschel-knitted fabric is used, if the surface thereof is observed under magnification, loops composed of surface threads range and a fine rib-shaped knitted structure is formed in a weft direction.

Since the size of the rib-shaped knitted structure can be relatively simply adjusted, when it is knitted to a predetermined size, it can be directly used as the grooves according to the present invention.

In contrast, in the racing swimsuit according to the present invention, it is also possible to form the groove sections by applying an embossing treatment to the surface of the fabric by a high temperature high pressure roll.

The embossing roll is a metal or resin roll having irregular portions formed therearound by engraving projections in a circumferential direction in correspondence with the depth, width and pitch of the grooves which are desired to be applied.

The roll is heated to a predetermined temperature in accordance with the material and the like of a fabric, a predetermined pressure is applied to the roll and the knitted fabric or the woven fabric is pressed by the roll at a constant velocity so as to be pressed. As a result, the surface of the fabric is compressed and shaped by the projecting portions of the roll, whereby fine grooves can be formed thereto in a desired depth, width and pitch.

The temperature, pressure and velocity of the roll are changed depending upon the material, weight ($g/m^2$), thickness of the fabric to be processed, and the working environment where the embossing treatment is carried out.

In general, when the above embossing treatment is applied to a knitted fabric composed of a 2-way tricot material having a weight of 120 to 330 $g/m^2$ and a thickness of 0.4 to 0.9 mm, it is suitable to set a roll temperature to about 180 to 220° C., a pressure to about 44130 to 53937 N (4500 to 5500 kgf) and a roll velocity to about 6 to 10 m/min.

The shape of the grooves according to the present invention is not particularly limited and suitably selected from a V-shape, a U-shape, a trapezoid shape and the like.

It is preferable that the fine grooves according to the present invention have a depth of 20 to 500 $\mu$m, a width of 200 to 1500 $\mu$m and a pitch of 300 to 3000 $\mu$m.

The following experiment for measuring a resistance value was carried out using a surface frictional resistance tester which will be described below in order to optimize the depth, width and pitch of the fine grooves according to the present invention.

Figure 6:
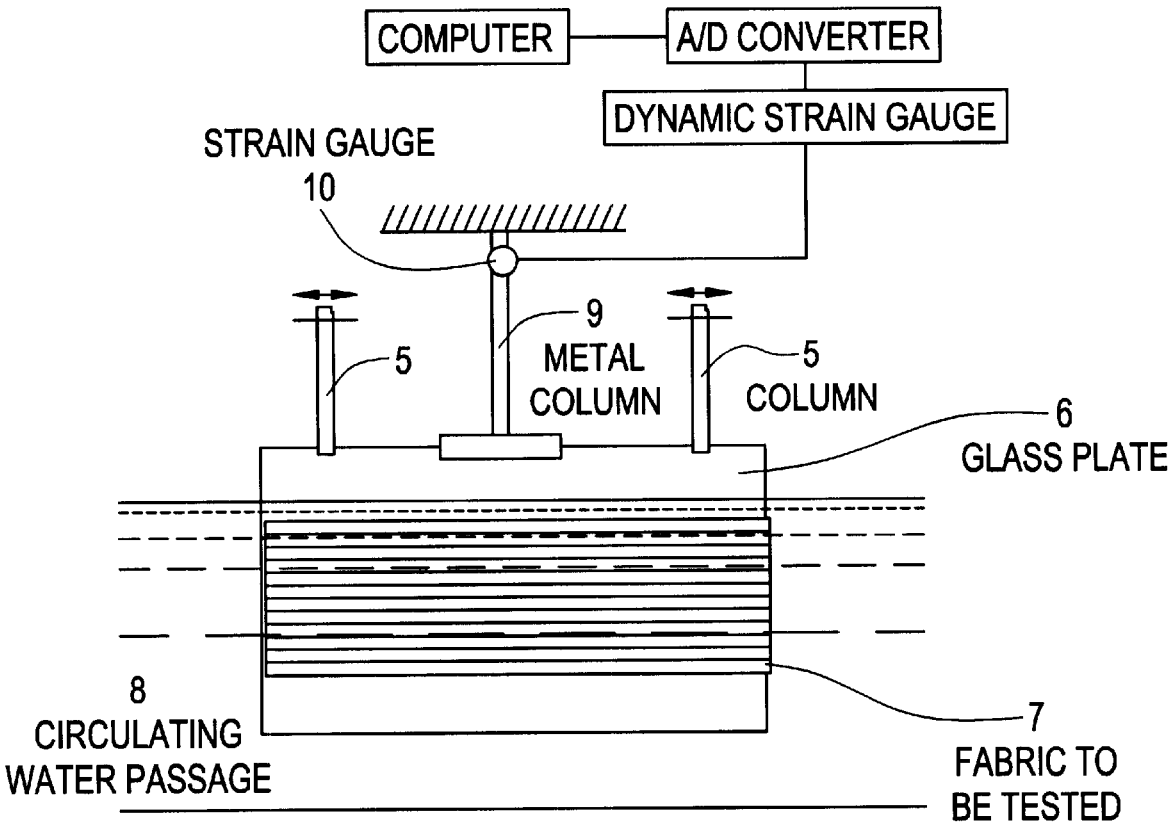
FIG. 6 is a view showing the outline of an experiment for measuring a resistance value using a surface frictional resistance tester.

As shown in FIG. 6, the surface frictional resistance tester for fabric was arranged such that test fabrics 7 were bonded on both the surfaces of a glass plate 6 (3000 mm long×600 mm wide) supported by columns 5 whose respective upper ends could be optionally moved in a horizontal direction and the glass plate 6 was sunk up to a predetermined depth in a water circulating water vessel 8.

A metal column 9 had a lower end fixed to the glass plate 6 and an upper end fixed to a ceiling. A strain gauge 10 was disposed at an upper portion of the metal column 9.

Therefore, the test fabrics 7 having the fine grooves formed thereon with the depth, width and pitch thereof changed were bonded on both the surfaces of the glass plate 6. The magnitude of the resistance received from the water flows flowing on the surfaces of the test fabrics 7 was measured by a dynamic strain gauge as an electric signal from the strain gauge 10 and displayed on and recorded by a personal computer through an A/D converter.

In the experiment, the glass plate, on which the test fabrics 7 were bonded, was disposed in the water circulating water vessel 8, the water flows having a flow velocity of 1.8 m/sec were impinged against the glass plate, and the resistance value was calculated from the value of entire resistance measured at the time.

Figure 7:
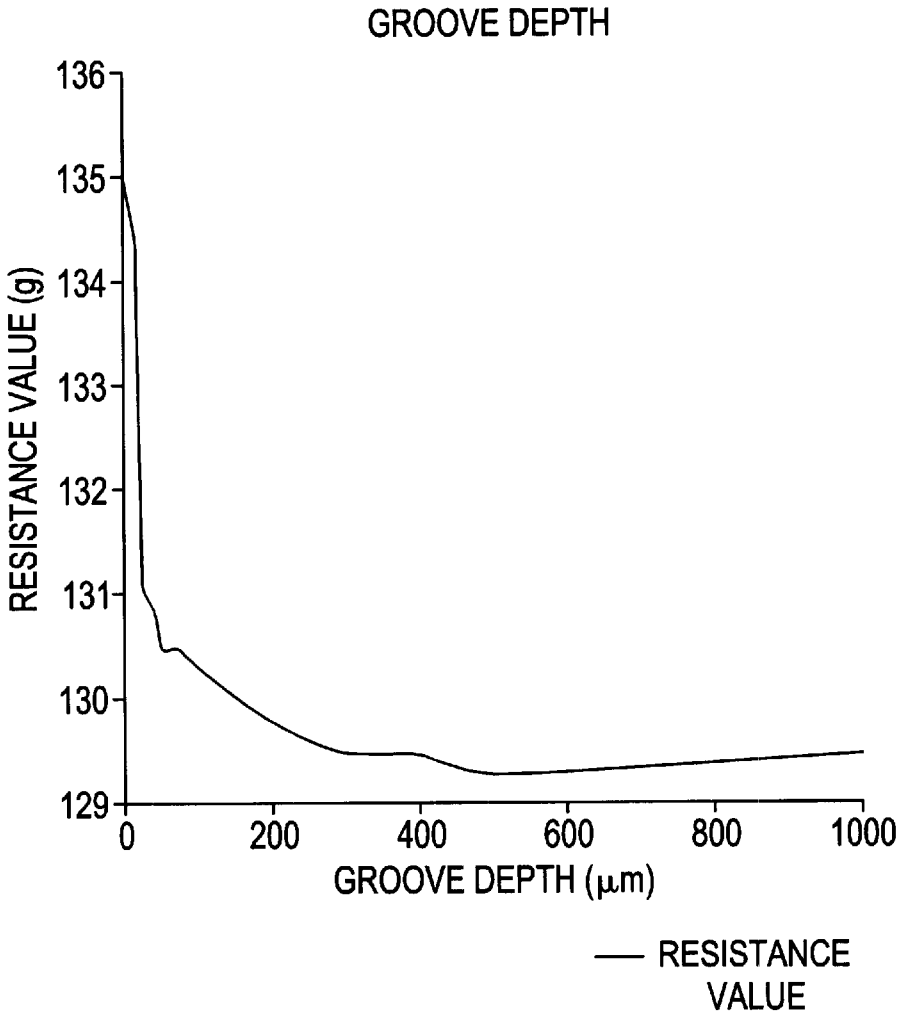
FIG. 7 is a graph showing a result of an experiment carried out to optimize the depth of the grooves according to the present invention.

First, FIG. 7 shows a result of the experiment carried out to optimize the depth of the grooves according to the present invention.

Note that, in the experiment, the width of the grooves was set to a constant value of 200 $\mu$m and the pitch thereof was set to a constant value of 2000 $\mu$m.

As apparent from FIG. 7, when the depth of the grooves was gradually increased and exceeded about 20 $\mu$m, the resistance value of the grooves was abruptly reduced, and when the depth exceeded about 500 $\mu$m, the resistance value was gradually increased.

Therefore, it can be understood that a meaningful effect can be obtained when the depth of the grooves is set to 20 to 500 $\mu$m.

In contrast, as to the relationship between the depth of the grooves and the thickness of the fabric used in the racing swimsuit according to the present invention, when the depth of the grooves is set to 500 $\mu$m or more, the manufacture of a fabric having such deep grooves is difficult in a manufacturing technology as well as a problem is caused in strength and there is a possibility that the fabric is liable to be broken.

Accordingly, when the depth of the grooves according to the present invention is 20 to 500 $\mu$m, a most meaningful effect can be obtained without being accompanied with difficulties in the manufacturing technology and strength.

Figure 8:
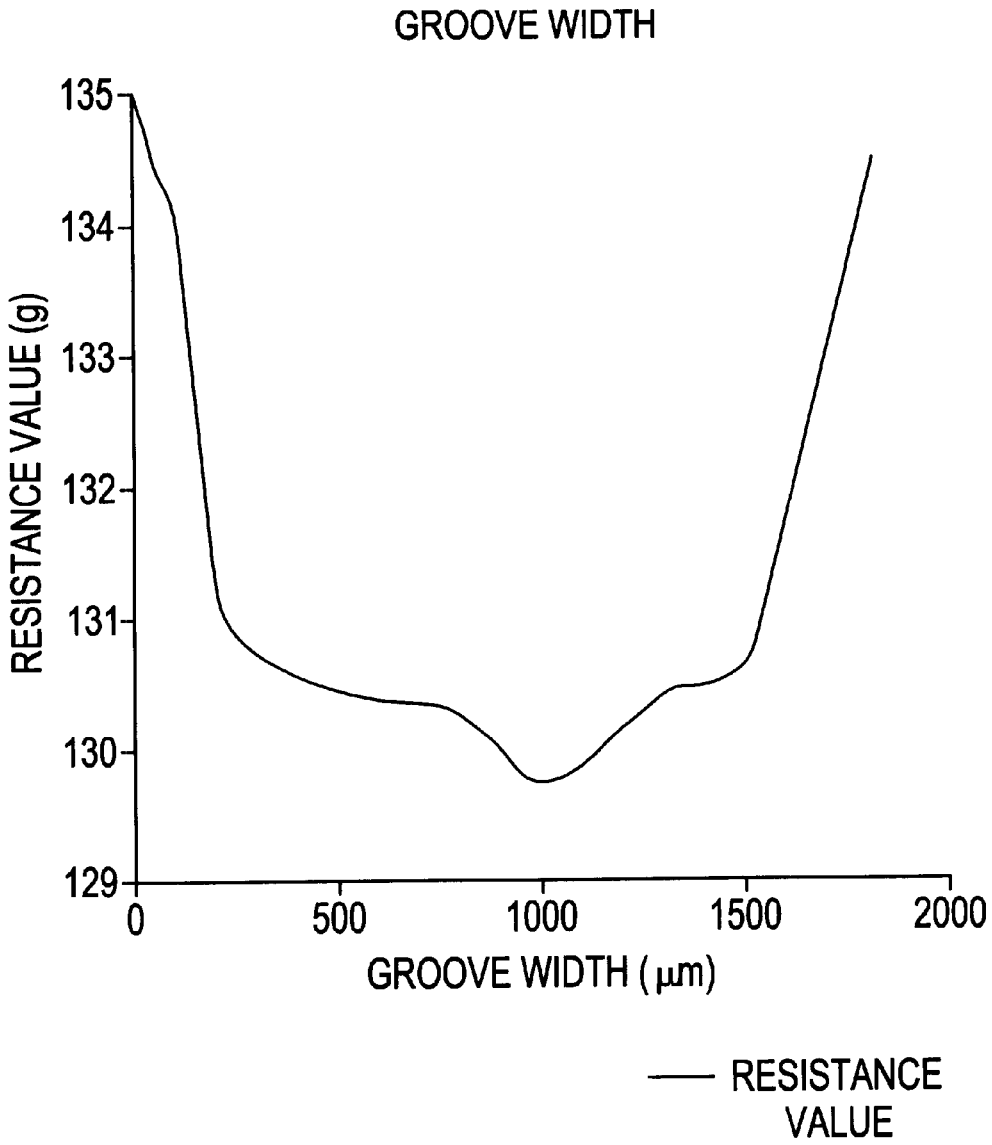
FIG. 8 is a graph showing a result of an experiment carried out to optimize the width of the grooves according to the present invention.

Next, FIG. 8 shows a result of the experiment carried out to optimize the width of the grooves according to the present invention.

Note that, in the experiment, the depth of the grooves was set to a constant value of 50 $\mu$m and the pitch thereof was set to a constant value of 2000 $\mu$m.

As apparent from FIG. 8, when the width of the grooves was gradually increased and exceeded about 200 $\mu$m, the resistance value of the grooves was abruptly lowered, and when the depth exceeded about 1500 $\mu$m, the resistance value was abruptly increased.

Therefore, it can be understood that a meaningful effect can be obtained when the depth of the grooves is 200 to 1500 $\mu$m.

Figure 9:
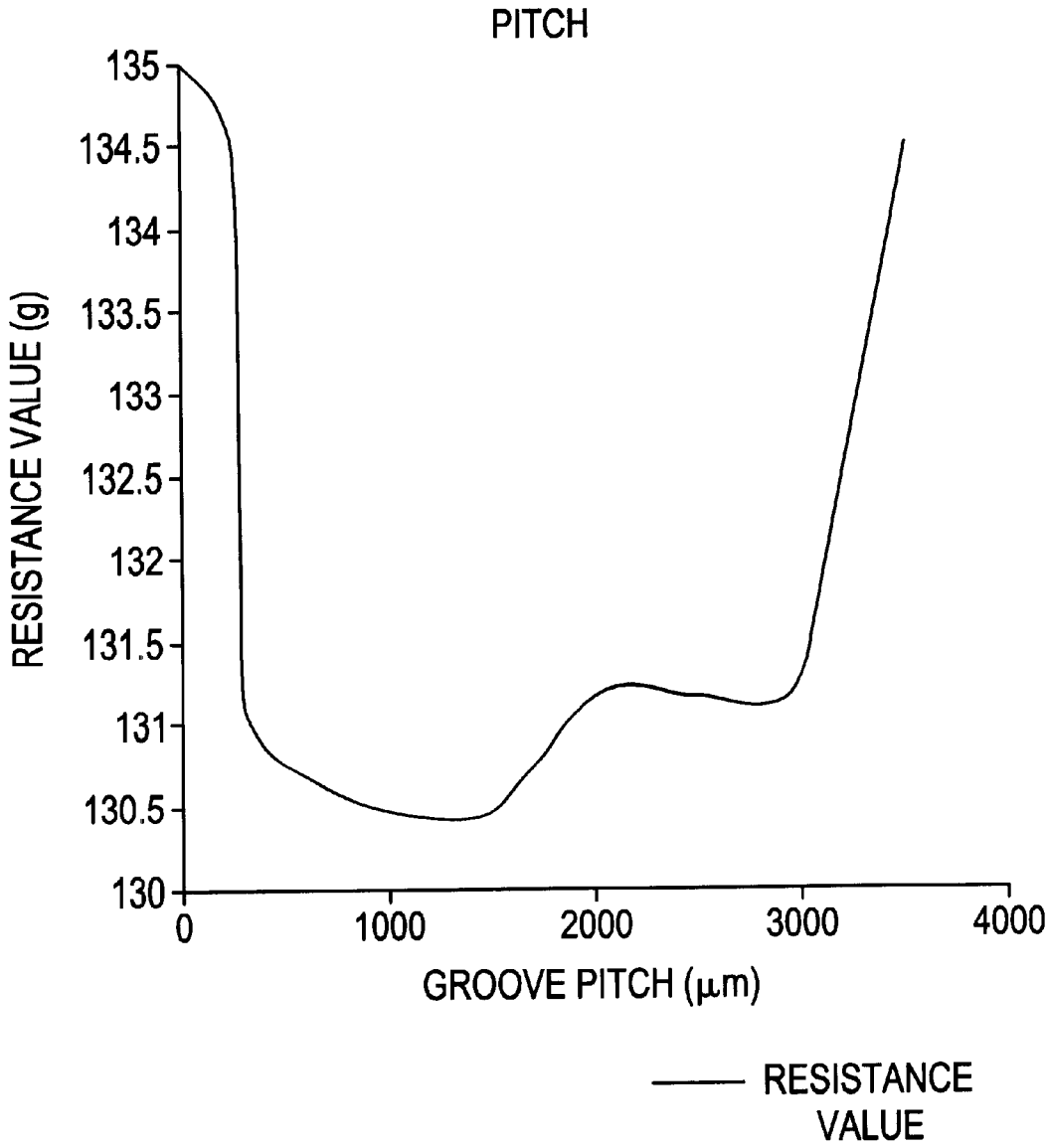
FIG. 9 is a graph showing a result of an experiment carried out to optimize the pitch of the grooves according to the present invention.

Similarly, the above experiment was repeated to optimize the pitch of the fine grooves according to the present invention. FIG. 9 shows a result of the experiment.

Note that, in the experiment, the depth of the grooves was set to a constant value of 50 $\mu$m and the pitch thereof was set to a constant value of 200 $\mu$m.

As apparent from FIG. 9, when the pitch of the grooves was gradually increased and exceeded about 300 $\mu$m, the resistance value of the grooves was abruptly lowered, and when the pitch exceeded about 3000 $\mu$m, the resistance value was abruptly increased.

Therefore, it can be understood that a meaningful effect can be obtained when the pitch of the grooves is 300 to 3000 $\mu$m.

In the racing swimsuit according to the present invention, it is also possible to apply a smoothing treatment to the region of the surface of the fabric forming the racing swimsuit other than the groove sections thereof.

It is possible to reduce the surface frictional resistance of the racing swimsuit according to the present invention more than a fabric to which no smoothing treatment is applied, by applying the smoothing treatment to the region of the surface of the fabric forming the racing swimsuit other than the groove sections thereof.

The smoothing treatment is also carried out by heating a roll having a smooth surface to a predetermined temperature in accordance with the material and the like of a fabric, applying a predetermined pressure to the roll and pressing the knitted fabric or the woven fabric by the roll at a constant velocity, similarly to the above embossing treatment.

At the time, it is preferable to apply the embossing treatment to form the above grooves after the smoothing treatment is applied to the entire surface of the fabric first.

Further, when the grooves are formed by the change of the structure of the woven structure or the knitted structure of the fabric, it is also possible to apply the smoothing treatment only to the top of the fine ridge-shaped knitted structure of the surface of the fabric where the grooves are formed.

An embodiment of a racing swimsuit according to the present invention will be described using drawings.

Figure 1B:
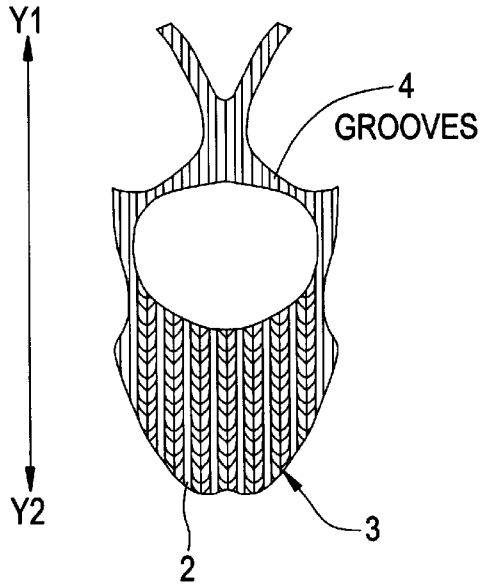

As shown in FIG. 1, the racing swimsuit according to the embodiment is formed by combining water repellent sections to which a water repellent treatment is applied to reduce surface frictional resistance, a plurality of fine grooves parallel to a body lengthwise direction to suppress the occurrence of turbulence on the surface of the swimsuit and a smoothing treatment.

A tricot knitted fabric composed of knitted union cloth of multi-filament threads of polyester synthetic fibers and polyurethane elastic threads is used as the material of the fabric used in the embodiment.

A pretreatment is applied to the surface of the fabric in the sequence of the water repellent treatment, the smoothing treatment, and the formation of the fine grooves by a final embossing treatment.

In the embodiment, the smoothing treatment is applied to the entire surface of the racing swimsuit and the plurality of fine grooves parallel to the body lengthwise direction are formed on the entire surface of the racing swimsuit.

Further, in the embodiment, the water repellent treatment is applied to the entire surface of the racing swimsuit so that the intermittently-water-repellent segments and the con tinuously-water-repellent segments are formed in the shape of stripes parallel to the body lengthwise direction.

Figure 2A:
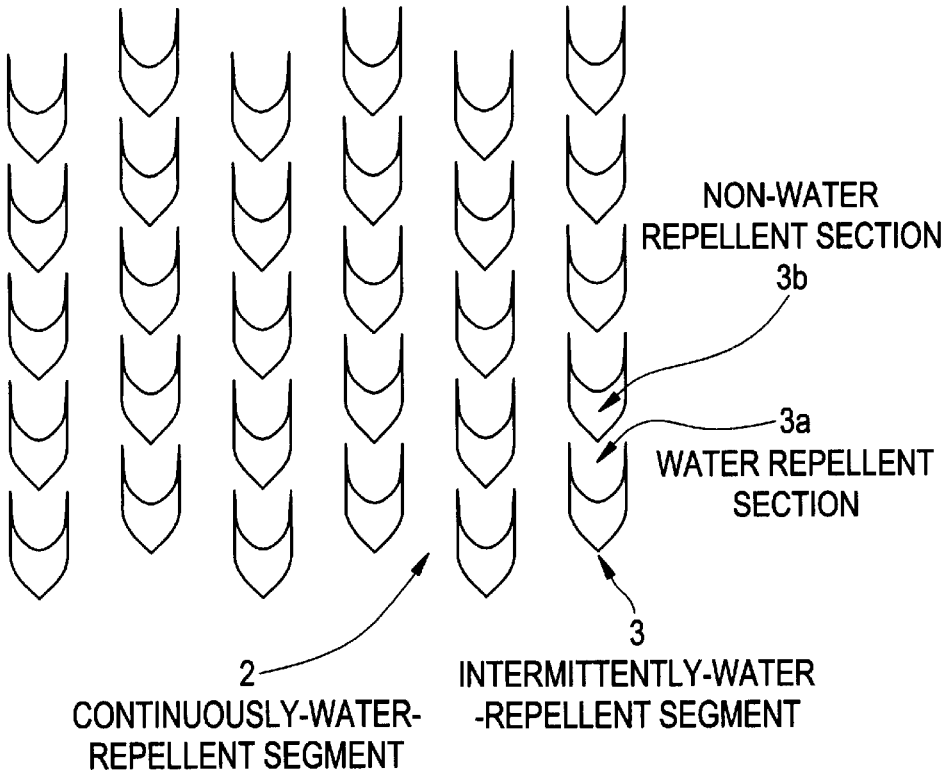
FIG. 2 is an enlarged view of a portion to which a water repellent treatment according to the present invention is applied.
Figure 2B:
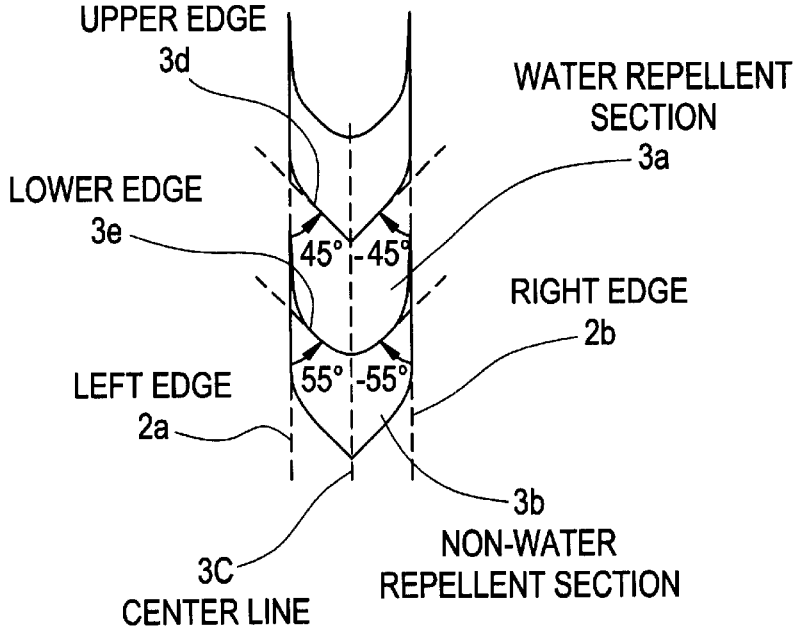

Specifically, as shown in FIG. 2, each intermittently-water-repellent segment 3 is composed of water repellent sections 3*a* and non-water-repellent sections 3*b* which are symmetrical with respect to a center line 3*c*. The upper edge 3*d* of each water repellent section 3*a* has an angle of 45° to each left edge 2*a* of the continuously-water repellent segment 2 and an angle of −45° to each right edge 2*b* thereof. Further, the lower edge 3*e* of each water repellent section 3*a* has an angle of 55° to each left edge 2*a* of the continuously-water-repellent segment 2 and an angle of −55° to each right edge 2*b* thereof.

The width of each stripe of the racing swimsuit according to the embodiment is 8 mm in the continuously-water-repellent segments 2 and 10 mm in the intermittently-water-repellent segments 3.

Figure 4B:
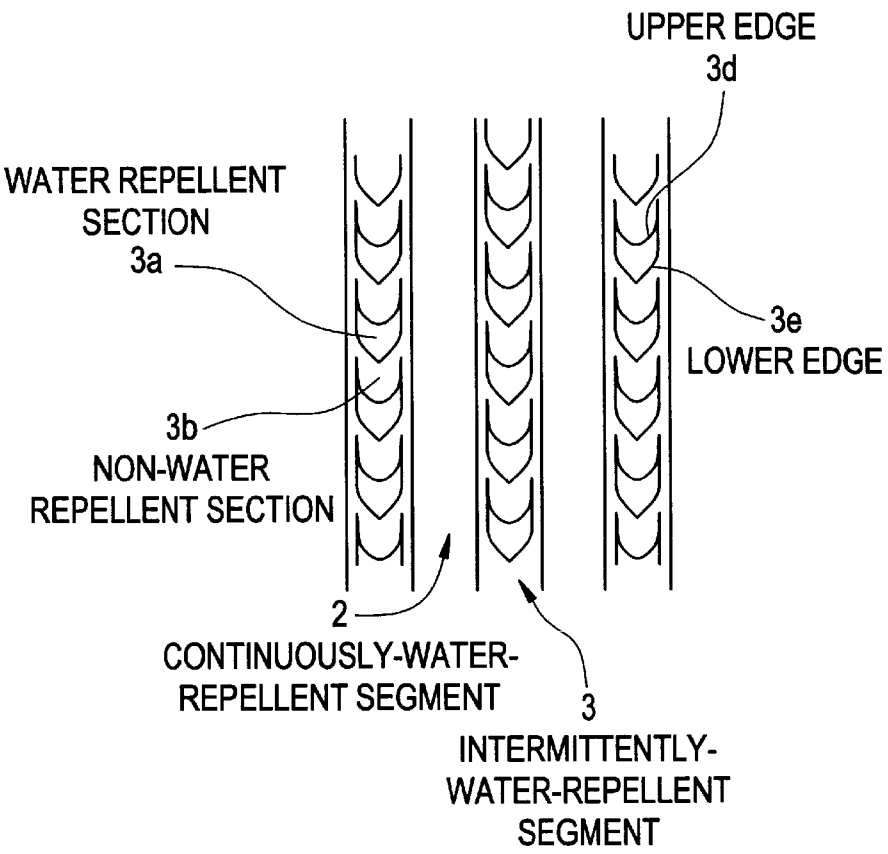
FIG. 4 is a view showing an embodiment of the shape of the portion to which the water repellent treatment according to the present invention is applied.
Figure 4A:
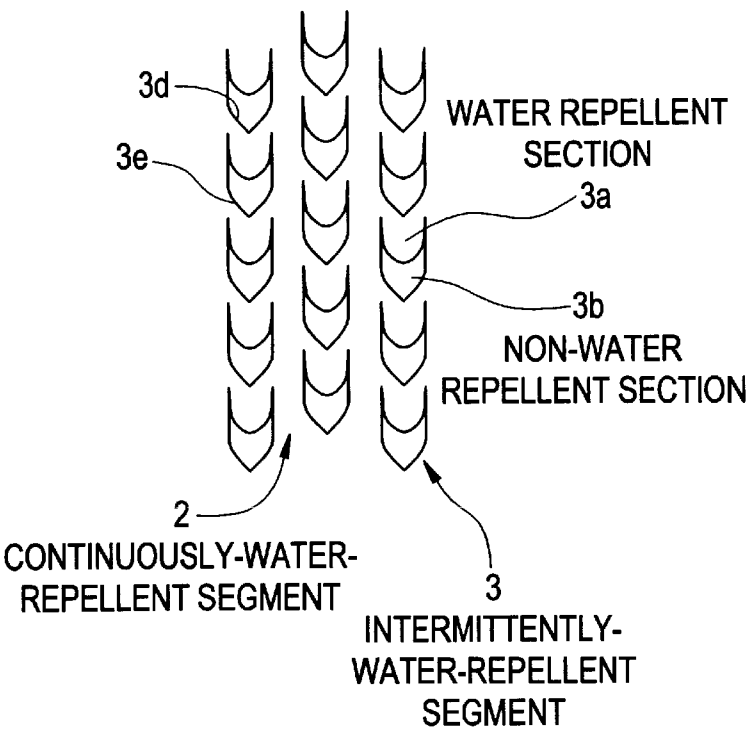

Further, as shown in FIG. 4(A), in the racing swimsuit according to the embodiment, the intermittently-water-repellent segments are formed such that both the right and left edges of the water repellent sections are coupled with the continuously-water-repellent segments adjacent thereto, respectively. However, it is possible as shown in FIG. 4(B) to form the intermittently-water-repellent segments such that both the right and left edges of the water repellent sections are not coupled with the continuously-water-repellent segments adjacent thereto, respectively.

A fluorine water repellent agent is used as a water repellent agent used in the racing swimsuit according to the embodiment. A printing treatment, which has been ordinarily used industrially, is used as a method of adhering the water repellent agent, and a roller printing machine is used as an apparatus to be used.

After the water repellent agent is adhered to the surface of the fabric, a heat treatment is carried out to accelerate a cross-linking reaction for fixing the water repellent agent to the fabric using a pin tenter.

In the embodiment, the ratio of the area of the water repellent sections occupied in the water repellent region, that is, the entire area of the racing swimsuit is about 75%.

Next, the smoothing treatment is applied to the fabric, to which the water repellent treatment has been applied in the predetermined shape, for the purpose of more reducing the surface frictional resistance. The smoothing treatment is applied to the region of the fabric forming the racing swimsuit other than the grooves on the surface thereof.

In the embodiment, the smoothing treatment is carried out by a conventionally executed method of heating a roll having a smooth surface to a predetermined temperature in accordance with the material and the like of the fabric, applying a predetermined pressure to the roll and pressing the knitted fabric or the woven fabric by the roll at a constant velocity Next, the plurality of fine grooves parallel to the body lengthwise direction are formed on the surface of the fabric, to which the water repellent treatment and the smoothing treatment have been applied, for the purpose of suppressing the occurrence of turbulence on the surface of the swimsuit.

In the embodiment, the grooves are uniformly formed on the entire surface of the racing swimsuit in a certain shape at constant intervals.

Figure 3:
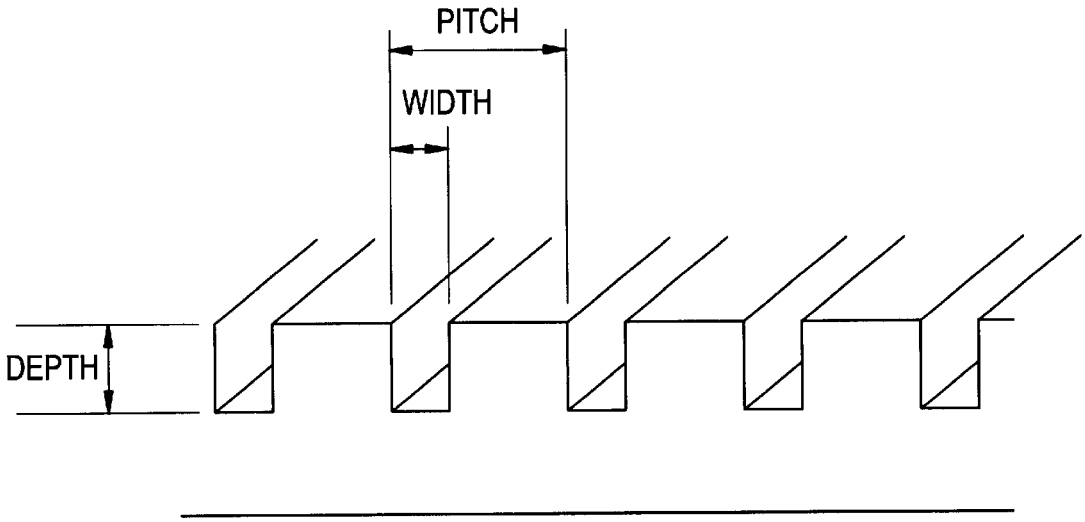
FIG. 3 is a view showing the cross-sectional shape of grooves according to the present invention.

Specifically, the shape of the grooves according to the embodiment is a rectangular shape as shown in FIG. 3. Each groove has a depth set to about 70 $\mu$m, a width set to about 470 $\mu$m and a pitch set to about 1470 $\mu$m (FIG. 3 schematically shows the shape of the grooves and the ratios of the depth and the like of the grooves are not actual ratios).

In the embodiment, the grooves are formed by embossing the surface of the fabric with a high temperature high pressure roll.

The embossing roll is a metal roll having irregular portions formed therearound by engraving projections corresponding to the above shape in the circumferential direction thereof.

While the temperature, pressure and velocity of the roll are changed depending upon the material, weight (g/m$^2$), thickness of the fabric to be processed, it is suitable in the embodiment that a roll temperature is set to about 200°, a pressure is set to about 53937N (5500 kgf) and a roll velocity is set to about 6 to 10 m/min.

The racing swimsuit according to the present invention is formed by cutting the elastic fabric, to which the pretreatment including the water repellent treatment, the smoothing treatment and the formation of the fine grooves by the embossing treatment has been applied, to predetermined shapes and sewing or boding side sections 1*a*, shoulder sections 1*b* and an inside-leg section 1*c* as shown in FIG. 1.

At the time, the intermittently-water-repellent segments, the continuously-water-repellent segments and the grooves must be disposed in the shape of stripes in a direction substantially parallel to the body lengthwise direction, that is, in a direction parallel to the Y1–Y2 direction in FIG. 1 in a sewed state.

However, as to the portions corresponding to the side portion and the protruding portion of a human body, it is also possible to select the directions in which the stripes are disposed so that they are at predetermined angles with respect to the body lengthwise direction.

INDUSTRIAL AVAILABILITY

The racing swimsuit according to the present invention reduces the surface frictional resistance in water by the provision of the water repellent region on the surface of the racing swimsuit as well as makes it possible to reduce even the frictional resistance of turbulence occurred on the surface of the swimsuit of a racer by the formation of the plurality of fine grooves parallel to the body lengthwise direction, whereby the fluid resistance caused by water flows can be reduced in multiplication.

What is claimed is:

1. A swimsuit comprising an elastic fabric, characterized in that the fabric has a plurality of fine grooves formed on a surface of the fabric and the surface has a water repellent region, to which a water repellent treatment is applied, on at least a portion thereof, and wherein the grooves are formed by an embossing treatment.

2. A swimsuit according to claim 1, further comprising a non-water repellent region composed of non-water-repellent sections, intermittently formed in the shape of stripes parallel to the body lengthwise direction of the swimsuit.

3. A swimsuit according to claim 1, further comprising a non-water repellent region formed in the shape of stripes parallel to the body lengthwise direction of the swimsuit in which water repellent sections are intermittently formed.

4. A swimsuit according to claim 2, wherein the intermittently-water-repellent sections are at least partially coupled with the water repellent region.

5. A swimsuit according to claim 3, wherein the water repellent sections are not coupled with water repellent region.

6. A swimsuit according to claim 1, further comprising upper and lower edges of water repellent sections having angles of −60° to 60° to the stripes directions.

7. A swimsuit according to claim 1, wherein 70 to 90% of the water repellent region is applied by the water repellent treatment.

8. A swimsuit according to claim 1, wherein the grooves are formed by a woven structure or a knitted structure of the elastic fabric.

9. A swimsuit according to claim 1, wherein the grooves have a depth of 20 to 500 $\mu$m, a width of 200–1500 $\mu$m and a pitch of 300 to 3000 $\mu$m.

10. A swimsuit according to claim 1, wherein the elastic fabric is subjected to smoothing treatment.

11. A swimsuit according to claim 3, wherein upper and lower edges of the water repellent sections have angles of −60° to 60° to the stripes direction.

* * * * *